US005526100A

United States Patent [19]

Misago et al.

[11] Patent Number: 5,526,100

[45] Date of Patent: Jun. 11, 1996

[54] IMAGE RECORDING APPARATUS HAVING A TONER QUANTITY CONTROL UNIT

[75] Inventors: Naomi Misago, Tokyo; Hirohisa Ohtsuka, Kawaguchi, both of Japan

[73] Assignee: Ricoh Company, Ltd., Tokyo, Japan

[21] Appl. No.: 350,026

[22] Filed: Nov. 29, 1994

[30] Foreign Application Priority Data

Dec. 7, 1993 [JP] Japan ..... 5-339997
Sep. 5, 1994 [JP] Japan ..... 6-235941

[51] Int. Cl.[6] ..... G03G 13/08; G03G 21/10

[52] U.S. Cl. ..... 355/246; 355/298; 118/689

[58] Field of Search ..... 355/246, 245, 355/298; 118/689, 688, 691, 652

[56] References Cited

U.S. PATENT DOCUMENTS 4,956,671 9/1990 Otsuka .
5,260,754 11/1993 Yano et al. .
5,289,241 2/1994 Sugiyama et al. ..... 355/260
5,307,128 4/1994 Murasaki et al. ..... 355/260
5,430,530 7/1995 Ott et al. ..... 355/260
5,430,532 7/1995 Ueda et al. ..... 355/260

FOREIGN PATENT DOCUMENTS 2265993 10/1993 United Kingdom .

*Primary Examiner*—R. L. Moses
*Attorney, Agent, or Firm*—Oblon, Spivak, McClelland, Maier & Neustadt

[57] ABSTRACT

An image recording apparatus includes a toner supplying unit for supplying fresh toner to a toner chamber via a toner supplying passage; a toner collecting unit for collecting toner which remains on a photosensitive medium after an image on the photosensitive medium is transferred to a sheet of paper, and for supplying the collected toner to the toner chamber via a toner collecting passage; a toner ratio detecting unit for detecting whether or not a ratio of the collected toner to the fresh toner relating to a quantity of to toner contained in the toner chamber is greater than a maximum allowable ratio; and a toner quantity control for it for allowing the toner supplying unit to supply free toner to the toner chamber when the ratio relating to the quantity of toner contained in the toner chamber is detected to be greater than the maximum allowable ratio.

7 Claims, 6 Drawing Sheets

IMAGE RECORDING APPARATUS HAVING A TONER QUANTITY CONTROL UNIT

BACKGROUND OF THE INVENTION

The present invention generally relates to an image recording apparatus using an electrophotographic technique, and more particularly to an image recording apparatus in which an image on a photosensitive medium is processed using toner from a toner chamber of a developing unit and transferred to a sheet of paper so that the image is recorded on the sheet of paper.

Image recording devices such as laser beam printers, copiers and facsimile machines use a known electrophotographic technique to record an image on a sheet of paper. In a laser beam printer, an electrostatic latent image on a photosensitive medium is formed by emitting laser light from a laser light source in accordance with image data. The electrostatic latent image on the photosensitive medium is processed by a developing unit using toner from a toner hopper of the developing unit so as to render the image visible. The processed image on the photosensitive medium is transferred to a sheet of paper so that the image is recorded on the sheet of paper.

In the image recording device mentioned above, a toner-end sensor detects whether the top of the toner contained in the toner hopper is below or above a predetermined height. The height or the position of the toner-end sensor arranged in the toner hopper defines a lower limit of the quantity of toner contained in the toner hopper. When the toner-end sensor detects that the top of the toner is below the predetermined height fresh toner supplied to the toner hopper.

However, in the image recording device mentioned above, toner on the photosensitive medium, which remains after the image transferring is performed is always collected and sent back to the toner hopper. Hereinafter, such toner will be referred to as the collected toner. The fresh toner and the collected toner are mixed by an agitator with its rotary blades within the toner hopper, and the mixed toner is used for the developing unit to process another image on the photosensitive medium.

FIG. 1 shows a toner hopper of a conventional developing unit. In order to use up all toner within the toner hopper, a toner-end sensor 1 is arranged at a position of a toner chamber 2 in the tone hopper, and the position is nearly at the bottom of the toner chamber 2. When the toner hopper contains a too small quantity of toner, or the quantity of toner in the toner chamber 2 has reached the lower limit, the toner-end sensor detects it. However, the remaining toner on the photosensitive medium is always collected and sent back to the toner hopper, regardless of the time of detection by the toner-end sensor 1.

Therefore, when a small quantity of toner within the toner hopper is above the lower limit prior to the time of the detection mentioned above, the ratio of the collected toner relative to the fresh toner within the toner hopper is increased, and it may possibly exceed 50 percent.

Generally, the collected toner mentioned above is the remaining toner on the photosensitive medium and it has not been transferred to the sheet of paper at the time of the image transferring. The polarity of the charge of the collected toner after the image transferring is inverse to the polarity of the charge of the fresh toner. If an image on the photosensitive medium is processed by using the toner whose ratio of the collected toner to the fresh toner is excessively high, the picture quality of a recorded image after the image transferring may be hurt due to the inverse polarity of the charge of the collected toner. For example, an undesired background shading in the background of the recorded image may appear, the optical density of the recorded image may be unusually low, or smudge with unusually large dots in the recorded image may appear.

SUMMARY OF THE INVENTION

Accordingly, it is a general object of the present invention to provide a novel and useful image recording apparatus in which the above mentioned problem is eliminated.

Another, more specific object of the present invention is to provide an image recording apparatus which controls a quantity of toner contained in a toner chamber so as to prevent a ratio of collected toner to fresh toner in the toner chamber from being greater than a maximum allowable ratio.

Still and the object of the present invention is to provide an image recording apparatus in which an image on a photosensitive medium is processed using toner from a toner chamber in which a ratio of collected toner to fresh toner is controlled to be below a maximum allowable ratio, thereby providing a recorded image with good picture quality and eliminating the background shading or image staining problems mentioned above.

The above mentioned objects of the present invention are achieved by an image recording apparatus which includes: a toner supplying unit for supplying fresh toner to a toner chamber via a toner supplying passage; a toner collecting unit for collecting toner which remains on a photosensitive medium after an image on the photosensitive medium is transferred to a sheet of paper, and for supplying the collected toner to the toner chamber via a toner collecting passage; a toner ratio detecting unit for detecting whether or not a ratio of the collected toner to the fresh toner relating to a quantity of toner contained in the toner chamber is greater than a maximum allowable ratio; and a toner quantity control unit for allowing the toner supplying unit to supply fresh toner to the toner chamber when the above mentioned ratio relating to the quantity of toner contained in the toner chamber is detected to be greater than the maximum allowable ratio.

According to the present invention, when the ratio of the collected toner to the fresh toner relating to the quantity of toner contained in the toner chamber is detected to be greater than the maximum allowable ratio, fresh toner is supplied to the toner chamber to maintain the ratio relating to the quantity of the toner in the toner chamber below the maximum allowable ratio. It is possible to prevent the quantity of inverse-polarity changed toner in the toner chamber from being to, great. Thus, the recorded image after the image transferring is performed has a good picture quality, and undesired effects due to the inverse-polarity charge of the collected toner, such as background shading and image staining problems, are eliminated.

BRIEF ON OF THE DRAWINGS

The other objects, features and advantages of the present invention will be more apparent from the following detailed description when read in conjunction with the accompanying drawings in which.

DESCRIPTION OF THE PREFERRED EMBODIMENTS

Figure 2:
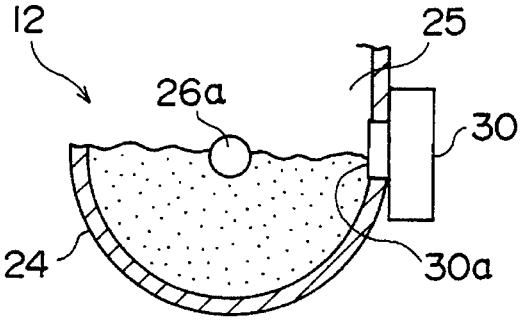
FIG. 2 is a cross-sectional view of a toner hopper of developing unit of a laser beam printer in a first embodiment of the present invention.

A description will now be given of the principles of an image recording apparatus according to the present invention. FIG. 2 shows a toner hopper 24 of a developing unit 12 provided in a laser beam printer to which the present invention is applied.

The image recording apparatus according to the present invention comprises a toner supplying unit, a toner collecting unit, a toner ratio detecting unit, and a toner quantity control unit. These units of the image recording apparatus may be realized by use of the hardware of the laser beam printer including a central processing unit, a program incorporated into the central processing Unit, and several specially-designed parts for the present invention which will be described later in detail.

In the image recording apparatus according to the present invention, an image on a photosensitive medium is processed using toner from a toner chamber 25 of the toner hopper 24 and transferred to a sheet of paper so that the image is recorded on the sheet of paper. The toner supplying unit supplies fresh toner to the toner chamber 25 via a toner supplying passage. The toner collecting unit collects toner remaining on the photosensitive medium after the image on the photosensitive medium is transferred to the sheet of paper, and supplies the collected toner to the toner chamber 25 via a toner collecting passage.

The toner ratio detecting unit detects whether or not the ratio of the collected toner to the fresh toner relating to a quantity of toner contained in the toner chamber 25 is greater than a maximum allowable ratio. The toner quantity control unit allows the toner supplying unit to supply fresh toner to the toner chamber 25 when the ratio relating to the quantity of toner contained in the toner chamber 25 is detected to be greater than the maximum allowable ratio.

The toner ratio detecting unit includes a toner-end sensor 30 which detects whether the top of the toner contained n the toner chamber 25 is above or below a predetermined height within the toner chamber. The toner-end sensor 30 is arranged in the toner chamber 25 at a position whose height is nearly the same as a height of a rotating shaft **26*a* of an agitator within the toner chamber 25. The toner-end sensor 30 has a sensing surface 30*a* which is arranged in the toner chamber 25 to sense the top of the toner contained in the toner chamber 25**.

The toner-end sensor 30 is, for example, a piezoelectric sensor which outputs a detection signal when the top of the toner is sensed by the sensing surface of the sensor located at a predetermined position.

Next, a description will be given of an image recording part of the laser beam printer to which the present invention is applied, with reference to FIGS. 3 and 4.

Figure 3:
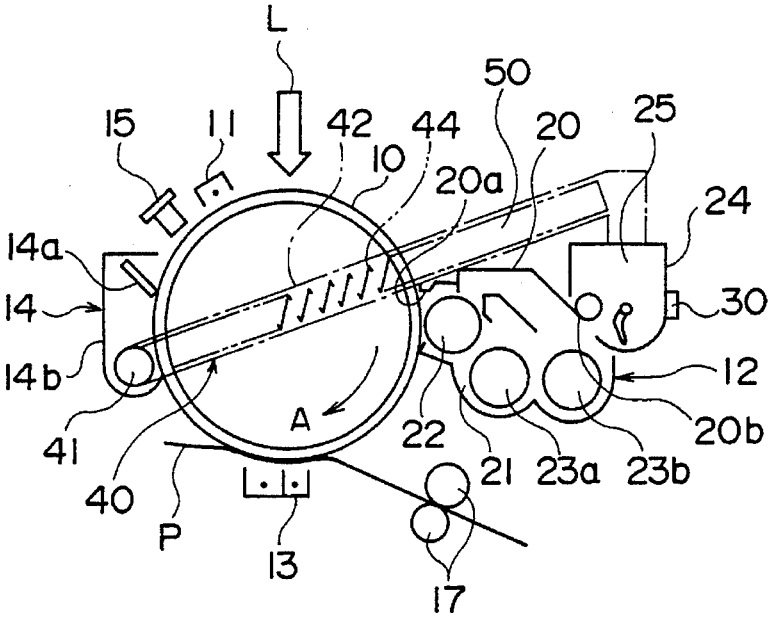
FIG. 3 is a cross-sectional view showing an image record part of the laser beam printer in the first embodiment.

FIG. 3 generally shows an image recording part of the laser beam printer in a first embodiment of the present invention. In FIG. 3, a photosensitive drum 10 which constitutes a main component unit (or the photosensitive medium) of the image recording part is provided in the middle of the laser beam printer. When the laser beam printer is operated, the photosensitive drum 10 is rotated in a rotating direction indicated by an arrow A in FIG. 3. In addition to the photosensitive drum 10, the image recording part comprises a charging unit 11, the developing unit 12, an image transferring unit 13, a cleaning unit 14, and a charge eliminating unit 15, and these units are arranged around the photosensitive drum 10. An optical writing unit (not shown), which has a laser light source emitting laser light "L" to form an electrostatic latent image on the photosensitive drum 10, is arranged in the laser beam printer above the photosensitive drum 10.

When an image is printed by the laser beam printer, a sheet of paper "P" fed from a paper cassette (not shown) is transported to the bottom of the photosensitive drum 10 in synchronism with the rotation of the photosensitive drum 10 by means of registration rollers 17. The photosensitive drum 10 is rotated in the rotating direction indicated by the arrow A. The charging unit 11 uniformly charges the surface of the photosensitive drum 10. The laser light "L" from the optical writing unit is emitted to the charged surface of the photosensitive drum 10 in accordance with image data to form an electrostatic latent image thereon. The electrostatic latent image is processed by the developing unit 12 using toner to render the image visible.

The image transferring unit 13 transfers the visible image on the photosensitive drum 10 into the sheet of paper "P" at the bottom of the photosensitive drum 10. After the image transferring, the sheet of paper "P" is transported to a fixing unit (not shown), and the visible image is fixed to the sheet of paper "P" by the fixing unit. The image is thus recorded on the sheet of paper "P", and after the image recording the sheet is ejected from the laser beam printer to the outside.

on the other hand, a certain quantity of toner still remains on the surface of the photosensitive drum 10 after the image is transferred to the sheet of paper. The cleaning unit 14 includes a cleaning blade **14*a* and a cleaning case 14*b*. The remaining toner is removed from the surface of the photosensitive drum 10 by the cleaning blade 14*a*, and the toner is collected into the cleaning case 14*b*. The charge eliminating unit 15 eliminates the charge from the surface of the photosensitive drum 10 so that the photosensitive drum 10 is ready to again be charged by the charging unit 11**

The developing unit 12 is composed of a main case 20 and the toner hopper 24. The main case 20 has a longitudinal axis extending in a transversal direction parallel with the rotating axis of the photosensitive drum 10. The main case 20 includes a developing chamber 21 internally arranged therein, and the main case 20 is provided with a processing window 20*a* at the photosensitive drum 10 side of the developing chamber 21, and with a toner feeding window 20*b* at the toner hopper 24 side of the developing chamber 21. A developing roller, 22 is arranged at the processing window 20*a*of the main case. The developing roller 22 is disposed such that the photosensitive drum 10 and the developing roller 22 face each other at the processing window 20*a*. Toner supplying rollers 23*a* and 23*b* are arranged near the toner feeding window 20*b* of the main case. The toner hopper 24 is attached to the main case 20 of the developing unit 12 through the toner feeding window 20*b*.

Figure 4:
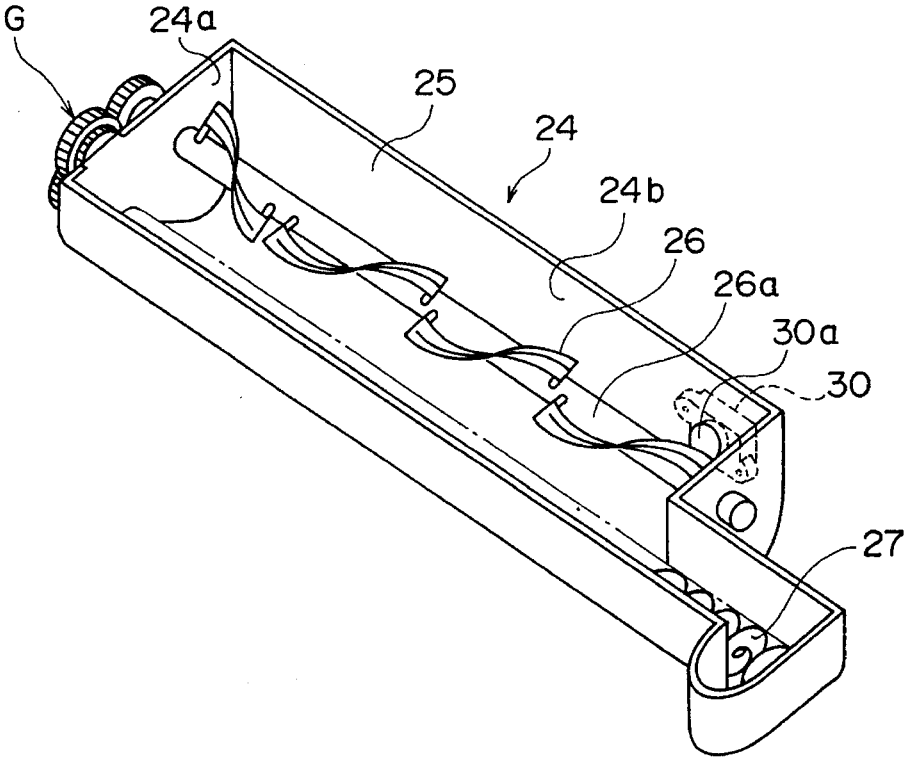
FIG. 4 is a perspective view of a toner hopper of a developing unit provided in the image recording part in FIG. 3.

FIG. 4 shows the toner hopper 24 of the developing unit 12 in FIG. 3 Similarly to the main case 20, the toner hopper 24 has a longitudinal axis extending in the transversal direction which is parallel with the rotating axis of the photosensitive drum 10. The toner chamber 25 is internally arranged in the toner hopper 24. A longitudinally extending agitator 26 and a longitudinally extending toner feeding screw 27 are disposed in the toner chamber 25 so that they are arranged in parallel with each other in a spaced relation.

The agitator 26 and the toner feeding screw 27 are secured at both ends to a toner hopper case, and they are rotatably supported thereon. The agitator 26 has a rotating shaft 26*a* with agitating blades attached. A gear train G is provided on the outside of a side wall 24*a* of the toner hopper case, and the gear train G is secured to the rotating shaft 26*a* of the agitator and to the toner feeding screw 27. The agitator 26 and the toner feeding screw 27 are rotated by a drive motor (not shown) through the gear train G in order to mix the toner inside the toner chamber 25 and to supply the mixed toner to the main case 20 of the developing unit 12 via the window 20*b*.

In the toner hopper 24 in FIG. 4, the toner-end sensor 3 is attached to the toner hopper case. More specifically, it is arranged at one end portion of a transversely extending wall 24*b* of the toner hopper case. The end portion where the toner-end sensor 30 is arranged is located near the right-hand end of the wall 24*b* of the toner hopper case in FIG.4. The toner-end sensor 30 includes the sensing surface 30*a* which comes in contact with toner within the toner chamber 25. The toner-end sensor 30 is arranged in the toner chamber 25 at a position whose height is nearly the same as a predetermined height within the toner chamber 25. The toner-end sensor 30 detects that the top of the toner contained in the toner chamber 25 is below or above he predetermined height within the toner chamber 25. When the top of the toner contained in the toner chamber 25 is detected to be below the predetermined height, it indicates that the quantity of the toner contained in the toner chamber 25 exceeds its maximum allowable level.

The toner-end sensor 30 described above constitutes an important part of the toner ratio detecting unit in the image recording apparatus. The toner-end sensor 30 arranged in the toner chamber 25 is located at an intermediate position of the wall 24*b* of the toner hopper case whose height is nearly the same as the height of the rotating shaft 26*a* of the agitator 26 in the toner hopper 24, as shown in FIG. 2. In the first embodiment described above, when the toner-end sensor 30 detects that the top of the toner contained in the toner chamber 25 is below the predetermined height, it indicates that a quantity of toner equivalent to half the entire capacity of the toner chamber 25 is contained in the toner hopper 24.

Figure 5:
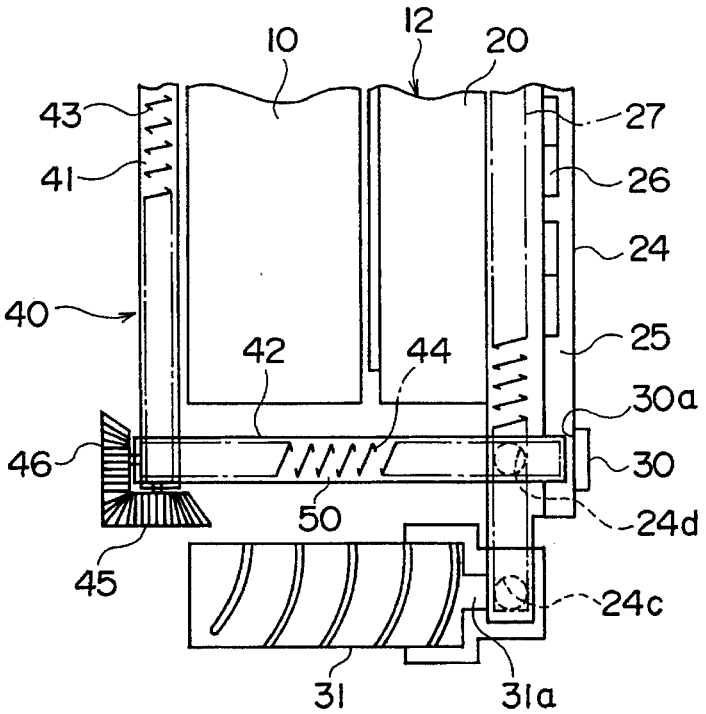
FIG. 5 is a top view showing the image recording part of the laser beam printer in FIG. 3.

FIG. 5 is a top view showing the image recording part of the laser beam printer in FIG. 3. The toner hopper 24, has an upper cover (not shown) which is disposed above the toner hopper case. In FIG. 5, a fresh toner inlet 24*c* is formed in the upper cover at an end portion of the upper cover, and the fresh toner inlet 24*c* is located above the toner feeding screw 27 of the toner hopper 24.

A toner bottle 31 containing fresh toner, which is a toner source to supply fresh toner to the toner chamber 29, is arranged at the side of the toner hopper 24, and an opening 31*a* of the toner bottle 31 is connected to the fresh toner inlet 24*c* in the upper cover of the toner hopper 24. The opening 31*a* and the fresh toner inlet 24*c* constitute the toner supplying passage of the toner supplying unit in the image recording apparatus.

The toner bottle 31 is rotatably supported, and it is rotated by a toner bottle motor (not shown) to supply fresh toner to the toner chamber 25. In the image recording apparatus, a motor drive signal, used to start rotating the toner bottle motor, is transmitted to the toner bottle motor in response to a detection signal from the toner-end sensor 30, so that fresh toner from the toner bottle 31 is supplied to the toner chamber 25 via the fresh toner inlet 24*c*. The toner bottle 31 and the toner bottle motor constitute the toner supplying unit in the image recording apparatus.

Figure 6:
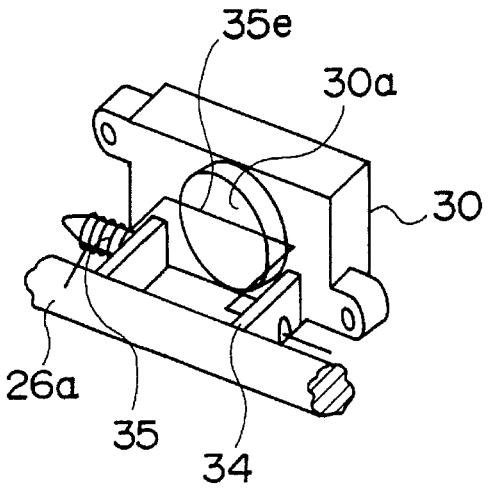
FIG. 6 is a perspective view showing a cleaning portion provided in the toner hopper in FIG. 4.
Figure 7:
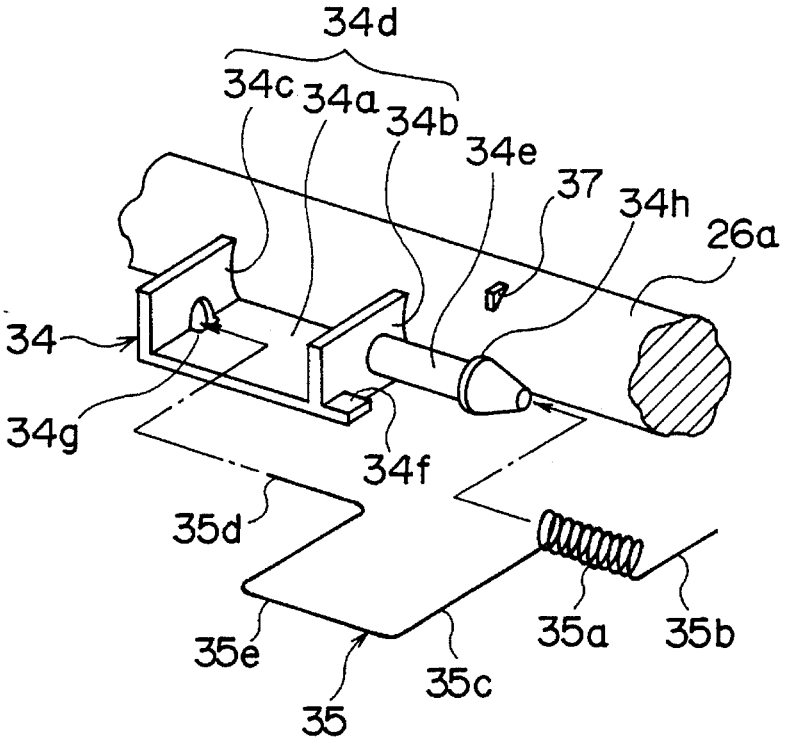
FIGS. 7 through 9 are views showing the cleaning portion provided in the toner hopper.
Figure 8:
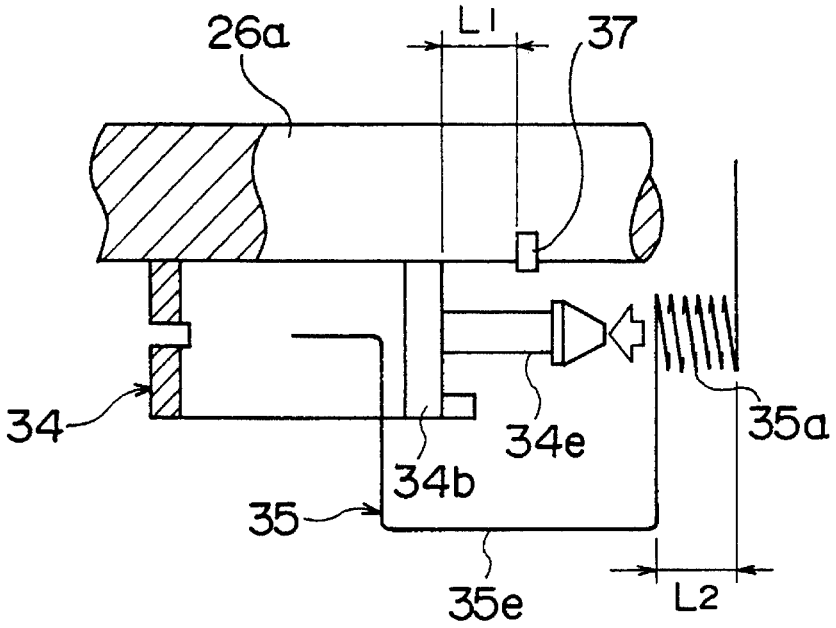
Figure 9:
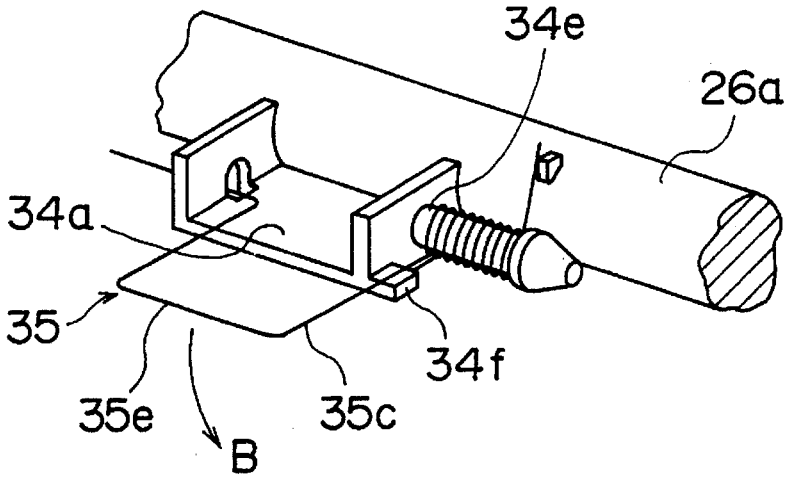

FIG. 6 shows a cleaning portion provided in the toner hopper 24 in FIG. 4. FIGS. 7 through 9 also show the cleaning portion of the toner hopper 24. In FIG. 6, a wire mounting member 34 is arranged on the rotating shaft 26*a* of the agitator 26 at a position in front of the sensing surface 30*a* of the toner-end sensor 30, and a resilient wire 35 is attached to the wire mounting member 34.

In FIG. 7, the wire mounting member 34 includes a main portion 34*d* which has a horizontal plate 34*a*, and two upright walls 34*b* and 34*c* provided at both ends of the horizontal plate. Also, the wire mounting member 34 includes a short cylindrical shaft 34*e* transversely extending from the middle of the upright wall 34*b* in parallel with the rotating shaft 26*a* of the agitator 26, a rectangular projection 34*f* transversely projecting from a corner portion of the upright wall 34*b*, and a hole 34*g* in the upright wall 34*c* at a bottom central portion of the upright wall 34*c*. The shaft 34*e* has a conical head 34*h* at the leading edge thereof. A rectangular connecting projection 37 is embedded in the rotating shaft 26*a* at a position in the vicinity of the shaft 34*e* of the wire mounting member 34.

In FIG. 7, the resilient wire 35 includes a coil portion 35*a*, a straight-end portion 35*b* radially extending from one end of the coil portion 35*a*, and an extended portion 35*c* from the other end of the coil portion 35*a*. The extended portion 35*c* merges to a rectangular be t portion 35*e*, and the farther end of the rectangular portion 35*e* is formed with a straight portion 35*d* which axially extends along a line passing through the central axis of the coil portion 35*a*. As shown in FIG. 8, the coil portion 35*a* of the resilient wire 35 is arranged such that an axial length "L2" of the coil portion 35*a* is smaller than an axial distance "L1" between the opposed surfaces of the upright wall 34*b* and the connecting projection 37.

When the resilient wire 35 is attached to the wire mounting member 34, the coil portion 35*a* is fitted onto the shaft 34*e*, the straight portion 35*d* is inserted into the hole 34*g* so that one end of the resilient wire 35 is rotatably supported on the wire mounting member 34 at the edge of the hole 34*g*. On the other hand, the straight-end portion 35*b* is connected to the rectangular connecting projection 37, and the coil portion 35*a* is compressed in the axial direction. Thus, separation of the straight portion 35*d* from the hole 34*g* of the wire mounting member can be prevented.

In FIG. 9, a biasing force of the coil portion 35*a* acts to rotate the portion 35*e* around the central axis of the shaft 34*e* in a rotating direction indicated by the arrow "B". As the wire mounting member 34 is secured to the rotating shaft 26*a* of the agitator 26, the portion 35*e* of the resilient wire 35 resiliently contacts and cleans the sensing surface 30*a* of the toner-end sensor 30, as shown in FIG. 6, when the rotating shaft 26*a* of the agitator is rotated. The biasing force of the coil portion 35*a* is canceled when the portions 35*c* and 35*e* rest on the horizontal plate 34*a* and the projection 34*f*.

Thus, in the first embodiment described above, the resilient wire 35 constitutes a cleaning portion for cleaning the sensing surface 30*a* of the toner-end sensor. The resilient wire 35 is arranged on the rotating shaft 26*a* of the agitator and is rotatable with the rotating shaft 26*a* when the agitator 26 is rotated. The resilient wire 35 has the portion 35*e* which resiliently contacts and cleans the sensing surface 30*a* of the toner-end sensor when the resilient wire 35 is rotated with the rotation of the agitator 26.

In take image recording part of the laser beam printer in FIG. 3, a toner collecting unit 40 is provided. The toner collecting unit 40 collects the toner remaining on the photosensitive drum 10 after the image on the photosensitive medium is transferred to the sheet of paper, and supplies the collected toner to the toner chamber 25 via a toner collecting passage.

As shown in FIGS. 3 and 5, the toner collecting unit 40 includes a first toner passage 41 and a second toner passage 50. The first toner passage 41 is arranged at the bottom of the cleaning case 14*b*. The first toner passage 41 transversely extends in parallel with the rotating axis of the photosensitive drum 10. The second toner passage 50 is formed by a toner transport pipe 42. The toner transport pipe 42 is connected to one end of the first toner passage 41 and extends in a slanting direction at right angles to the first toner passage 41 as shown in FIG. 3. The other end (not shown in FIG. 5) of the first toner passage 41 is connected to a bottom portion of the cleaning case 14*b* of the cleaning unit 14.

A collected toner inlet 24*d* is formed in the upper cover of the toner hopper 24 at a position adjacent to the fresh toner inlet 24*c*. The collected toner inlet 24*d* is located above the toner feeding screw 27 and at the position where the second toner passage 50 and the toner feed screw 27 intersect each other. As shown in FIG. 3, an upper end of the toner transport pipe 42 is connected to the collected toner inlet 24*d*, so that the second toner passage 50 connects with the internal space of the toner chamber 25 via the collected toner inlet 24*d*.

In FIG. 5, the toner collecting unit 40 includes toner transport screws 43 and 44. The toner transport screw 43 is provided in the first toner passage 41, and the toner transport screw 44 is provided in the second toner, passage 50. The toner transport screws 43 and 44 rotatably supported. A gear 45 is coupled to one end of the toner transport screw 43, and a gear 46 is coupled to one end of the toner transport screw 44. The gears 45 and 46 are engaged with each other. The gear 45 is rotated by a drive motor (not shown) in synchronism with the rotation of the photosensitive drum 10, and the rotating force of the drive motor is transmitted to the toner transport screws 43 and 44 via the gears 45 and 46 to transport the collected toner from the cleaning unit 14 to the toner hopper 24.

When the toner-end sensor 30 detects, during operation of the laser beam printer, that the top of the toner contained in the toner chamber 25 is below the predetermined height within the toner chamber 25, the toner quantity control unit transmits a motor drive signal to the toner bottle motor in response to a detection signal from the toner-end sensor 30. As the toner bottle 31 is rotated by the toner bottle motor, fresh toner from the toner bottle 31 is supplied to the toner chamber 25 via the fresh toner inlet 24*c*.

On the other hand, the toner collected by the cleaning unit 14 drops on the toner transport screw 43 during operation of the laser beam printer. The collected toner s transported by the toner transport screw 43 through the first toner passage 41 in the transversal horizontal direction, and it is further transported by the toner transport screw 44 through the second toner passage 50 in the upward slanting direction. The collected toner is thus sent back to the toner Chamber 25 via the collected toner inlet 24*d*.

The fresh toner and the collected toner are mixed by the agitator 26 within the toner chamber 25, while the mixed toner is transported by the toner feeding screw 27 in the transversal horizontal direction within the toner chamber 25. The toner from the toner chamber 25 is supplied to the developing chamber 21 of the developing unit via the toner feeding window 20*b*. The toner within the developing chamber 21 is transported to the developing roller 22 by the toner supplying roller 23*a* and 23*b*. The toner is further supplied by the developing roller 22 to the surface of the photosensitive drum 10. Thus, the electrostatic latent image on the photosensitive drum 10 is processed using the toner from the toner chamber 25 to render the image visible.

Figure 10:
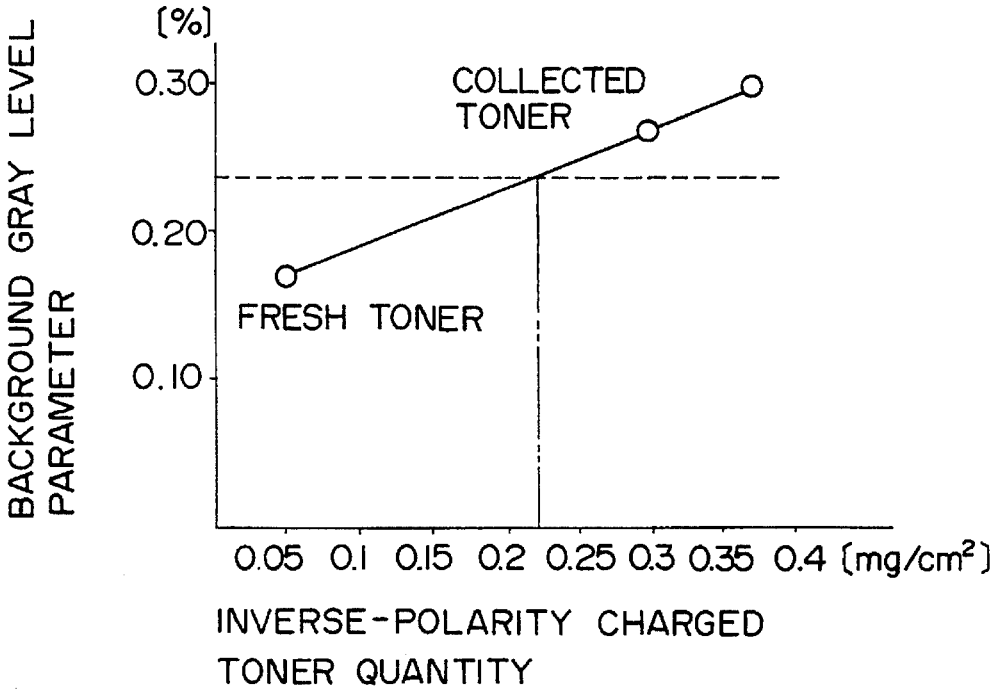
FIG. 10 is a graph showing a relationship between an inverse-polarity charged toner quantity and a background gray level parameter.

FIG.10 is a graph showing a relationship between an inverse-polarity charged toner quantity and a background gray level parameter with respect to the quantity of toner contained in the toner chamber 25. In the graph in FIG. 10, values of the inverse-polarity charged toner quantity and values of the background gray level parameter are obtained by experimental measurement. The values of the inverse-polarity charged toner quantity are in milligrams per square centimeter ($mg/cm^2$), and the values of the background gray level parameter are in percent (%)

In the image recording apparatus according to the present invention, the maximum allowable ratio used by the toner ratio detecting unit is determined based on the values of the background gray level parameter obtained from images which are recorded using the fresh toner and using the collected toner. The maximum allowable ratio is determined based on values of the inverse-polarity charged toner quantity obtained from the fresh toner and from the collected toner.

In the measurement mentioned above, the background gray level parameter is the percentage of a measured value of the gray level of a background portion of a sample (recorded image) to a measured value of the gray level of a reference image reproduced from a white paper. Values of the gray level of images are measured by using a densitometer. The densitometer is any suitable one of photographic image density measuring instruments which are commonly used.

Also, in order to obtain values of the inverse-polarity charged toner quantity, various samples of the mixed toner whose ratios of the collected toner to the fresh toner are different are prepared. The mixed toner of each sample is continuously cascaded to a metal plate while a bias voltage equivalent to a normal polarity charge toner commonly used in the laser beam printer is applied to the metal plate. A quantity of the mixed toner each sample remaining on or sticking to the metal plate after the above procedure is the inverse-polarity charged toner. A value of the inverse-polarity charged toner quantity is obtained by measuring the weight of the mixed toner remaining on the metal plate and by measuring the surface area of the metal plate. That is, the inverse-polarity charged toner quantity is equal to the measured weight (mg) of the remaining toner divided by the measured surface area ($cm^2$) of the metal plate.

Generally, the picture quality of a recorded image whose background gray level parameter is below 0.22% is a acceptable. Therefore, if the background gray level parameter is below 0.22%, the picture quality of recorded images which have been processed with a mixed toner (or the mixture of the fresh toner and the collected toner) is acceptable and is not significantly hurt by the inverse-polarity charged toner in he mixed toner. The acceptable level of the background gray level parameter, which is approximately 0.22%, is indicated by a dotted line in FIG. 10.

In the graph in FIG. 10, the inverse-polarity charged toner quantity relating to the sample of 100% fresh toner is equal to 0.05 $mg/cm^2$, and the inverse-polarity charged toner quantity relating to another sample containing abundant collected toner is equal to 0.3 $mg/cm^2$. The latter sample is 6 times greater than the former sample in the inverse-polarity charged toner quantity.

Herein, it is assumed that the ratio of the collected toner to the fresh toner, relating to the quantity of toner contained in the toner chamber 25, is proportional to the value of the inverse-polarity charged toner quantity. The graph in FIG. 10 shows that the inverse-polarity charged toner quantity for the acceptable level of the background gray level parameter is approximately 0.225 $mg/cm^2$, as indicated by a two-dotted chain line.

In the graph in FIG. 10, the background gray level parameter relating to the sample of 100% fresh toner is equal to 0.17%, and the background gray level parameter relating to the sample of the collected toner is rather greater than the acceptable level. Therefore, in order to obtain recorded images whose picture quality is acceptable, it is necessary to make the ratio of the collected toner to the fresh toner, relating to the quantity of toner contained in the toner chamber 25, below a maximum allowable ratio. If the quantity of the toner contained in the toner chamber 25 is controlled so as to make the above mentioned ratio below the maximum allowable ratio, the background gray level quantity of a recorded image in that case can be lower than the acceptable level. For example, the maximum allowable ratio is determined by experience to be 37% or less.

In the image recording apparatus in the first embodiment, fresh toner is supplied to the toner chamber 25 when it is detected that the quantity of toner contained in the toner chamber 25 is smaller than half of the entire capacity of the toner chamber. Thus, the ratio of the collected toner to the fresh toner is controlled so as to be below 24%, and thus the inverse polarity charged toner quantity can be below the acceptable level of 0.22%.

In addition, the cleaning portion **35*e* of the resilient wire 35 resiliently contacts and cleans the sensing surface 30*a* of the toner-end sensor 30 when the agitator 26** is rotated.

In addition, in the laser beam printer described above, the toner transport screws 43 and 44, which are to transport the collected toner to the toner chamber 25, are rotated in synchronism with the rotation of the photosensitive drum 10. Thus, the collected toner is steadily supplied to the toner chamber 25 by the toner transport screws 43 and 44 as long as the photosensitive drum 10 is rotated during operation of the laser beam printer. In other words, the quantity of the collected toner supplied to the toner chamber 25 is proportional to the total time the photosensitive drum 10 is rotated. Therefore, when the quantity of toner contained in the toner chamber is small, the ratio of the collected toner to the fresh toner is great. Conversely, when the quantity of toner contained in the toner chamber is great, the ratio of the collected toner to the fresh toner is small.

Figure 1:
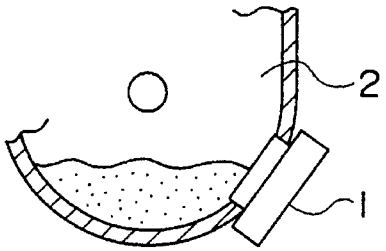
FIG. 1 PRIOR ART
FIG. 1 is a cross-sectional view of a toner hopper of a conventional developing unit with a toner-end sensor provided therein.
Figure 11:
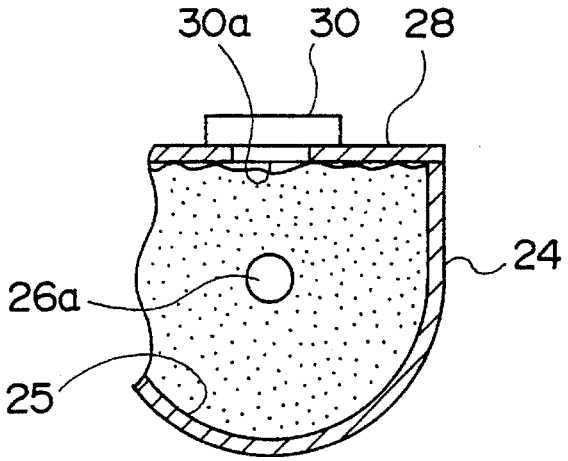
FIG. 11 is a cross-sectional view showing an undesired position of the toner-end sensor arranged in the toner hopper.

From the above described feature of the laser beam printer, it is conceivable that the toner-end sensor 30 can be arranged at a position whose height is higher than the height of the rotating shaft **26*a* of the agitator 26 within the toner chamber 25. However, in a case of FIG. 11 in which the toner-end sensor 30 is arranged on the top of an upper cover 28 of the toner hopper 24 (the highest position within the toner hopper 24), the toner quantity control does not function until the toner chamber 25 is fully filled with toner and the operating load on the rotating shaft 26*a* of the agitator 26 during operation becomes excessively high. Thus, it is undesirable to arrange the toner-end sensor 30 at excessively high position within the toner chamber 25 as to arrange the toner-end sensor 30 at an excessively low shown in FIG. 11. For the same reason, it is undesirable to arrange the toaner-end sensor 30 at an excessively low position within the toner chamber as shown in FIG.1**.

Next, a description will be given of an image recording apparatus in a second embodiment of the present invention, with reference to FIGS. 12 and 13.

In tie first embodiment previously described, when the toner-end sensor 30 detects that the top of the toner contained in the toner chamber 25 is below the predetermined height within the toner chamber 25, the toner quantity control unit allows the toner supplying unit to supply fresh toner to the toner chamber 25, in order to prevent the ratio of the collected toner to the fresh toner relating to the quantity of toner contained in the toner chamber 25 from being greater than the maximum allowable ratio.

The toner quantity control of the present invention to prevent the ratio of the collected toner to the fresh toner from being greater than the maximum allowable ratio may be realized by the image recording apparatus in the following embodiment.

Figure 12:
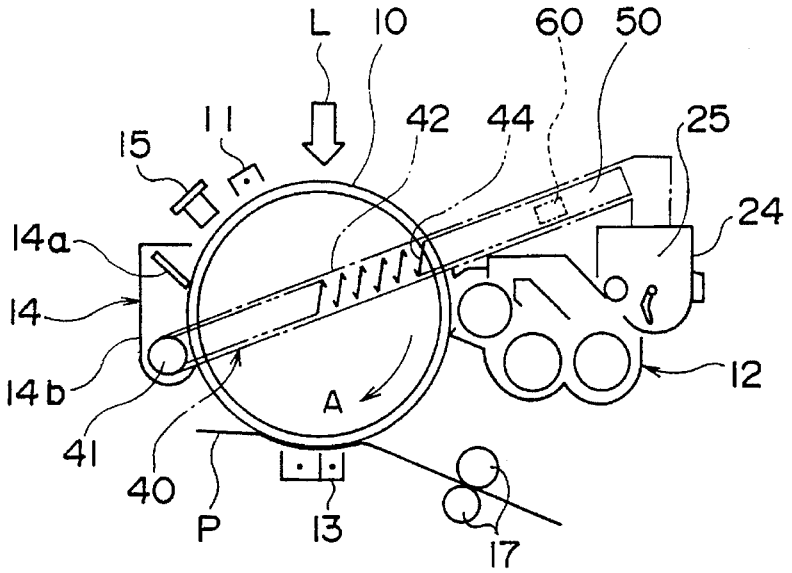
FIG. 12 is a cross-sectional view showing an image recording part of the laser beam printer in a second embodiment of the present invention.

FIG. 12 shows an image recording part of the laser beam printer in a second embodiment of the present invention. In FIG. 12, the units which are the same as corresponding units of the image recording part shown in FIG. 3 are designated by the same reference numerals, and a description thereof will be omitted.

In the image recording part in FIG. 12, a toner sensor 60 is arranged in a second toner passage 50 at a predetermined height within the second toner passage 50. The position of the toner sensor 60 is indicated by a dotted line in FIG. 12. The toner sensor 60 detects whether the top of collected toner in the second toner passage 50 is above or below the predetermined height The toner sensor 60 constitutes an important part of the toner ratio detecting unit in the second embodiment. That is, when the toner sensor 60 detects that the to of the collected toner in the second toner passage 50 is above the predetermined height within the second toner passage 50, the toner quantity control unit allows the toner supplying unit to supply fresh toner to the toner chamber 25, in order to prevent the ratio of the collected toner to the fresh toner relating to the quantity of toner contained in the toner chamber 25 from being greater than the maximum allowable ratio. Conversely, when the toner sensor 60 detects that the top of the collected toner in the second toner passage 50 is below the predetermined height within the second toner passage 50, the toner quantity control unit does not have the toner supplying unit supply fresh toner to the toner chamber 25.

Figure 13:
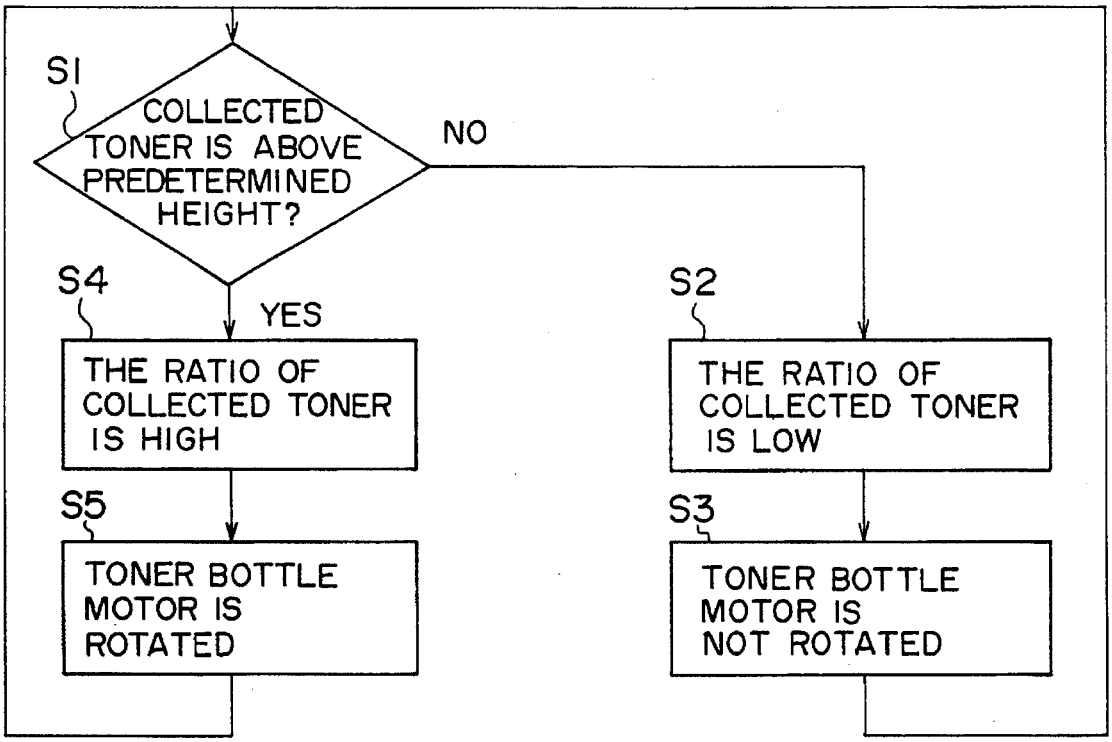
FIG. 13 is flow chart for explaining a toner quantity control procedure performed in the second embodiment.

FIG. 13 shows a toner quantity control procedure performed in the second embodiment. In the flow chart in FIG. 13, step S1 detects whether the top of the collected toner contained in the second toner passage 50 is above the predetermined height within the second toner passage 50 by use of a detection signal output from the toner sensor 60.

If the result at step S1 is negative, step S2 determine that the collected toner is not presently entering the toner chamber 25 since the quantity of the collected toner in the second toner passage 50 is not great enough to be above the maximum allowable quantity. Step S3 does not transmit a motor drive signal to toner bottle motor, so that the toner bottle motor is stopped and fresh toner from the toner bottle 31 is not supplied to the toner chamber 25.

If the result at step S1 is affirmative, step S4 determines that the quantity of the collected toner in the second toner passage 50 is great enough to be above the maximum allowable quantity. Step S5 transmits a motor drive signal to the toner bottle motor, so that the toner bottle motor is rotated to supply fresh toner from the toner bottle 31 to the toner chamber 25.

After either the above step S3 or the above step S5 is performed, the same procedure including the steps S1 through S5 is repeated. By performing this toner quantity control procedure, it is possible to prevent the ratio of the collected toner to the fresh toner, relating to the quantity of toner contained in the toner chamber 25, from being greater than the maximum allowable ratio (e.g. 37%). As the inverse-polarity charged toner quantity is kept below the maximum allowable level (e.g. 0.225 $mg/cm^2$), the background gray level parameter can be kept below the acceptable level (e.g. 0.22%).

The toner sensor 60 in the second embodiment may be a piezoelectric sensor, an optical sensor or another suitable sensor. The optical sensor detects the presence of toner at a detection site based on the reflected light intensity change when light is emitted to the toner.

Further, the present invention is not limited to the above described embodiments, and variations and modifications may be made without departing from the scope of the present invention.

What is claimed is:

1. An image recording apparatus in which an image on a photosensitive medium is processed using toner from a toner chamber and is transferred to a sheet of paper so that the image is recorded on the sheet of paper, comprising:

toner supplying means for supplying fresh toner to the toner chamber via a toner sue plying passage;

toner collecting means for collecting toner which remains on the photosensitive medium after the image on the photosensitive medium is transferred to the sheet of paper, and for supplying the collect toner to the toner chamber via a toner collecting passage, and wherein the toner collecting passage supplies toner directly to the toner chamber;

toner ratio detecting means for detecting whether or not a ratio of the collected toner to the fresh toner relating to a quantity of toner contained in the toner chamber is greater than a maximum allowable ratio; and toner quality control means for allowing said toner supplying means to supply fresh toner to the toner chamber when said ratio relating to the quantity of toner the maximum allowable ratio;

wherein the toner collecting means supplies collected toner to the toner chamber independent of a detection of the ratio relating to the quantity of toner contained in the toner chamber by the ratio detecting means.

2. The image recording apparatus according to claim 1, wherein said toner ratio detecting means comprises a toner-end sensor which detects whether the top of the toner contained in the toner chamber is above or below a predetermined height within the toner chamber.

3. The image recording apparatus according to claim 2, wherein said toner-end sensor is arranged in the toner chamber at a position whose height is nearly the same as a height of a rotating shaft of an agitator within the toner chamber.

4. The image recording apparatus according to claim 2, wherein said toner ratio detecting means further comprises a resilient wire for cleaning a sensing surface of the toner-end sensor, said resilient wire being arrange on a rotating shaft of an agitator and is rotatable with the rotating shaft when the agitator is rotated, said resilient wire having a portion which contacts and cleans the sensing surface of the toner-end sensor when said agitator is rotated.

5. The image recording apparatus according to claim 1, wherein said toner ratio detecting means comprises a toner sensor which is arranged in the toner collecting passage at a predetermined height so as to detect whether the top of the collected toner contained in the toner collecting passage is above or below the predetermined height.

6. The recording apparatus according to claim 1, wherein the maximum allowable ratio of the toner ratio detecting means is determined based on a relationship between a background gray level parameter and an inverse-polarity charged toner quantity with respect to the quantity of toner contained in the toner chamber.

7. The image recording apparatus according to claim 1, wherein the maximum allowable ratio of the toner ratio detecting means is determined based on values of an inverse-polarity charged toner quantity obtained from the fresh toner and from the collected toner.

* * * * *